US007153147B2

(12) United States Patent
Li et al.

(10) Patent No.: US 7,153,147 B2
(45) Date of Patent: Dec. 26, 2006

(54) ELECTRICAL CONNECTOR WITH DETACHABLE PICK-UP DEVICE

(75) Inventors: Xue-qing Li, Kunsan (CN); Chun-sheng Li, Kunsan (CN); Feng Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/169,984

(22) Filed: Jun. 28, 2005

(65) Prior Publication Data

US 2006/0128186 A1 Jun. 15, 2006

(30) Foreign Application Priority Data

Dec. 10, 2004 (CN) ..... 200420054277

(51) Int. Cl.
*H01R 13/44* (2006.01)

(52) U.S. Cl. ..... 439/135

(58) Field of Classification Search ..... 439/135, 439/940, 235, 136, 134
See application file for complete search history.

(56) References Cited

U.S. PATENT DOCUMENTS 4,396,245 A 8/1983 Lane
4,872,848 A * 10/1989 Mouissie ..... 439/135
5,249,977 A 10/1993 Tanaka et al.
5,688,133 A 11/1997 Ikesugi et al.
6,210,225 B1 4/2001 Cai et al.
6,439,901 B1 8/2002 Ji et al.
6,932,647 B1 * 8/2005 Murayama ..... 439/607
2005/0101186 A1 * 5/2005 Xiang et al. ..... 439/607

* cited by examiner

*Primary Examiner*—Phuong Dinh
(74) *Attorney, Agent, or Firm*—Wei Te Chung

(57) ABSTRACT

An electrical connector assembly comprising a housing (1) having a mounting face (11) adapted for mounting on a printed circuit board, a top face (12) substantially parallel to the mounting face and a mating face (16) substantially perpendicular to the mounting face, and defining a mating cavity (17) in the mating face thereof; a plurality of terminals (2) received in the housing and each having a contact portion (21 or 22) exposed in the mating cavity; and a releasable pick-up device (200) including a main plate (3) covering the top face of the housing to provide a flat upper surface (30) for receiving suction by a vacuum transfer assembly, and a auxiliary plate (4) perpendicularly extending from the main plate to cover an opening of the mating cavity in the mating face of the housing.

2 Claims, 5 Drawing Sheets

ELECTRICAL CONNECTOR WITH DETACHABLE PICK-UP DEVICE

BACKGROUND OF THE INVENTION

1. Field of the Invention

The present invention relates to an electrical connector, and more particularly to an electrical connector having a detachable pick-up device for facilitating picking up and positioning by a vacuum suction nozzle or the like.

2. Description of Related Art

Vacuum transfer and placement mechanisms are well known in the electronic assembly art and are used for retrieving electronic components, such as connectors, from a supply source and transferring them by applying negative air pressure to the connectors and placing them onto a printed circuit board in a preselected position for soldering. Typically, such mechanisms are provided with a transfer arm having a suction end to suck up the connector. As most connectors are devoid of flat, smooth, large surface fit for engaging with the suction end, pick-up devices of every variety of form are designed for various connectors to provide such flat, smooth surfaces for receiving suction by vacuum transfer assemblies.

Generally, every connector should have a mounting face to be mounted to a printed circuit board (hereafter referred to as PCB), and a mating face for engaging with a mating connector, which can extend either parallel to or perpendicularly to the mounting face. Wherein a connector having a mating face parallel to its mounting face is referred to as "vertical connector", and a connector having a mating face perpendicular to its mounting face is referred to as "right angled connector". Pick-up devices for the so-called "vertical connector" are described in U.S. Pat. Nos. 4,396,245, 5,249,977, 5,688,133, and 6,439,901. Those pick-up devices are all attached to mating faces of connectors to cover mating openings therein and make top surfaces thereof vacuum mechanism engagement surfaces. However, this kind of pick-up device is not fit for the so-called "right angled connector".

U.S. Pat. No. 6,210,225 discloses a pick-up device for a "right angled connector". The connector conwrises a base and a projection projecting forwardly from the base. The base has an under face serving as a mounting face, and the mating portion has a front face serving as a mating face and defining a mating opening therein. The pick-up device is attached to a top of the base to provide en upward vacuum mechanism engagement surface. However, as the pick-up device only coven the top of the base, a center of the engagement surface it provides horizontally deviates from a center of gravity of the connector, which causes a tilt of the connector while being picked up or transferred by a vacuum mechanism. That results in an unstable engagement between the connector and the vacuum mechanism and an unreliable transfer operation. Otherwise, as the mating face of the "right angled connector" is perpendicular to its mounting face, terminals in the mating opening thereof is prone to being hit by foreign matter if there is no cover or the like to protect them.

Therefore, it is desired to provide a pick-up device for a "right angled connector" which performs a stable engagement with a vacuum mechanism and which provides a cover portion to shield a mating opening of the connector from foreign matter.

SUMMARY OF THE INVENTION

An object of the present invention is to provide a pick-up device for used with vacuum transfer of connectors which performs a stable engagement with a vacuum mechanism, by which reliable vacuum transfer is ensured.

Another object of the present invention is to provide a pick-up device for a connector of the type having a mating face perpendicular to its mounting face which has a cover portion to shield a mating opening of the connector from foreign matter.

In order to achieve above-mentioned objects, a connector in accordance with a preferred embodiment of the present invention includes a housing having a mounting face adapted for mounting on a printed circuit board, a top face substantially parallel to the mounting face and a mating face substantially perpendicular to the mounting face, and defining a mating cavity in the mating face thereof; a plurality of terminals received in the housing and each having a contact portion exposed in the mating cavity; and a releasable pick-up device including a main plate covering the top face of the housing to provide a flat upper surface for receiving suction by a vacuum transfer assembly, and a auxiliary plate perpendicularly extending from the main plate to cover an opening of the mating cavity in the mating face of the housing.

Other objects, advantages and novel features of the present invention will become more apparent from the following detailed description of the present embodiment when taken in conjunction with the accompanying drawings.

DETAILED DESCRIPTION OF THE INVENTION

Figure 1:
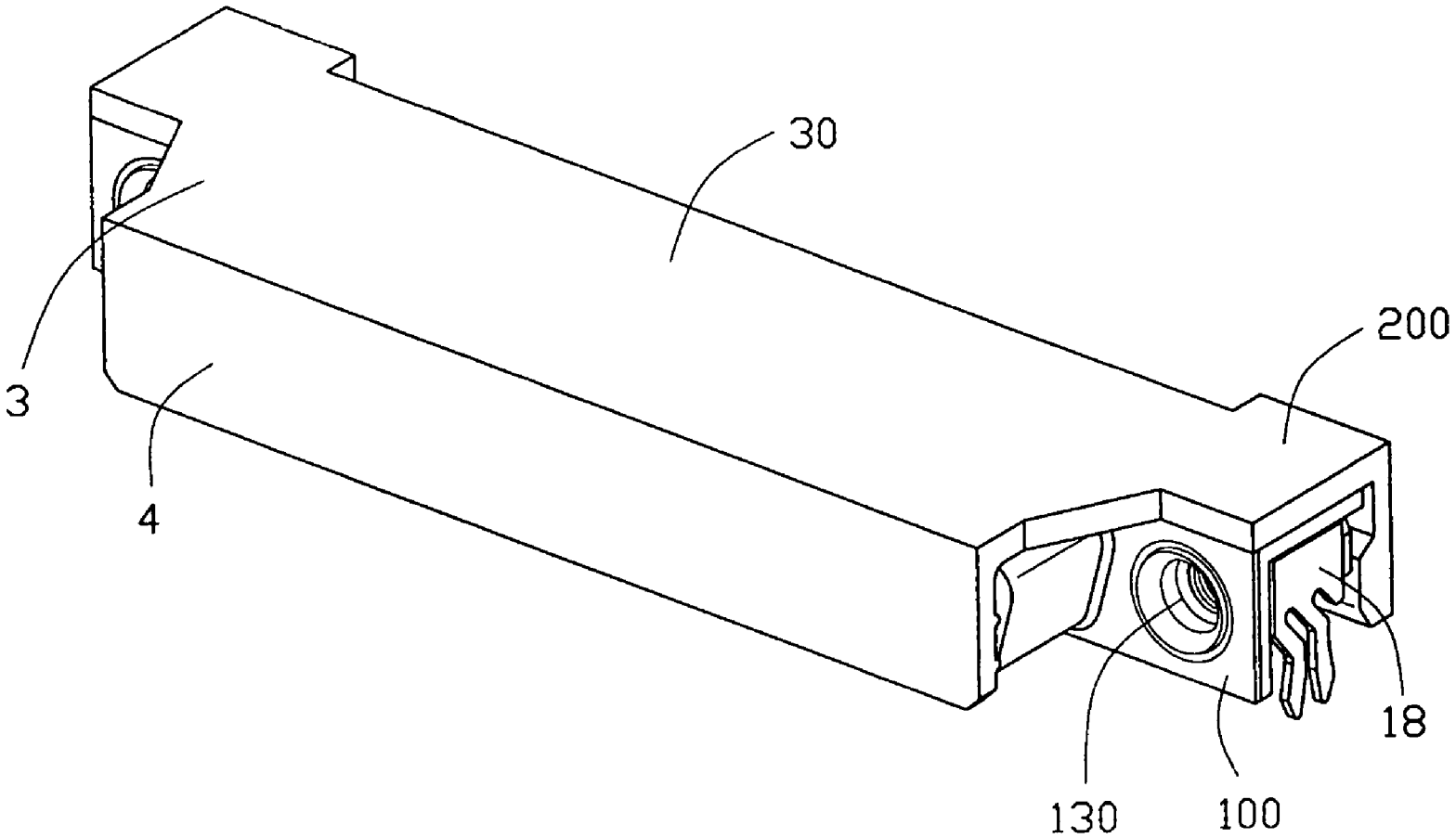
FIG. 1 is an assembled perspective view of a connector assembly in accordance with the preferred embodiment of the present invention.

Reference will now be made to the drawing figures to describe the preferred embodiment of the present invention in detail.

Figure 2:
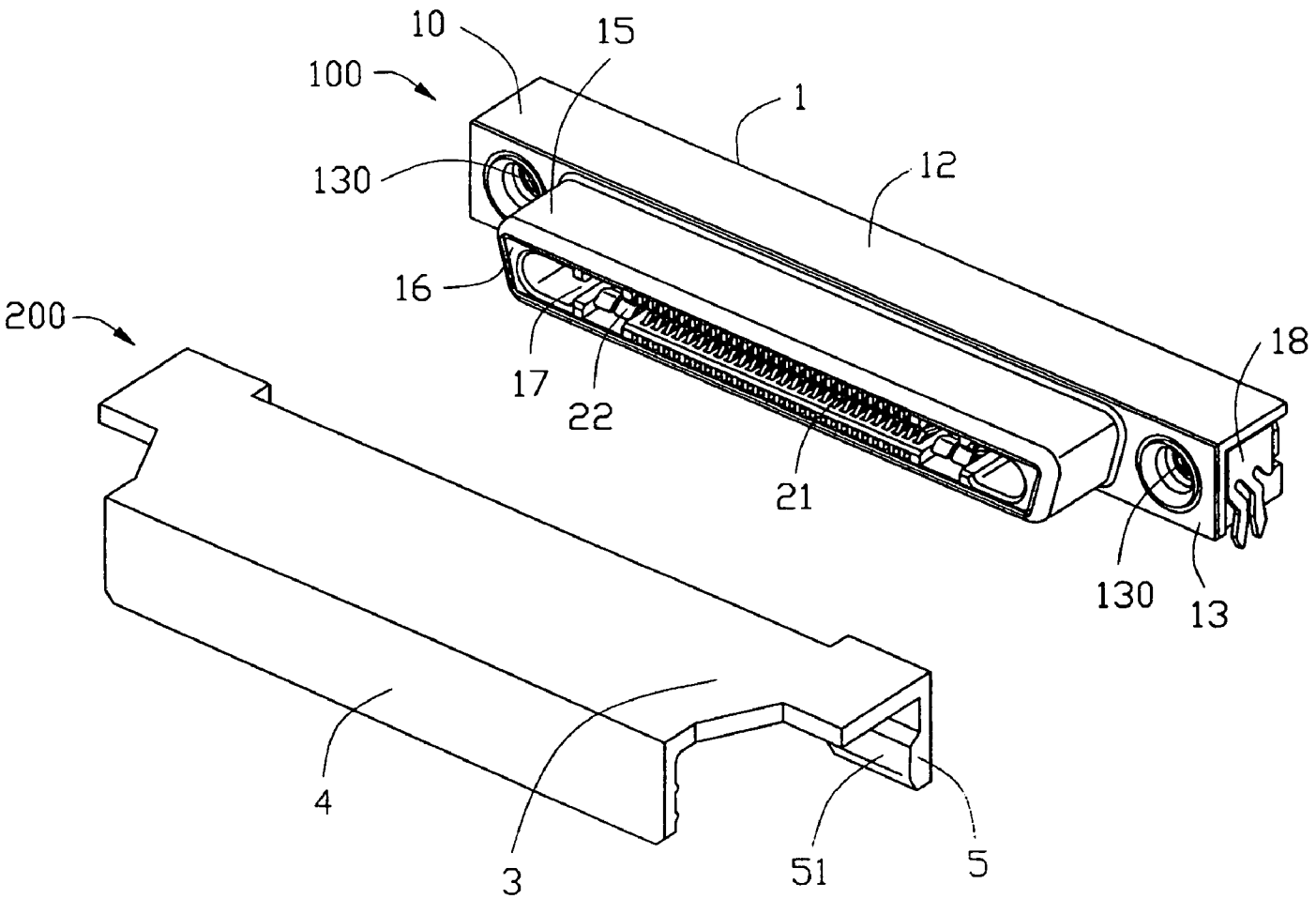
FIG. 2 is an exploded perspective view of the connector assembly of FIG. 1, wherein a pick-up cap has been detached from the connector.
Figure 4:
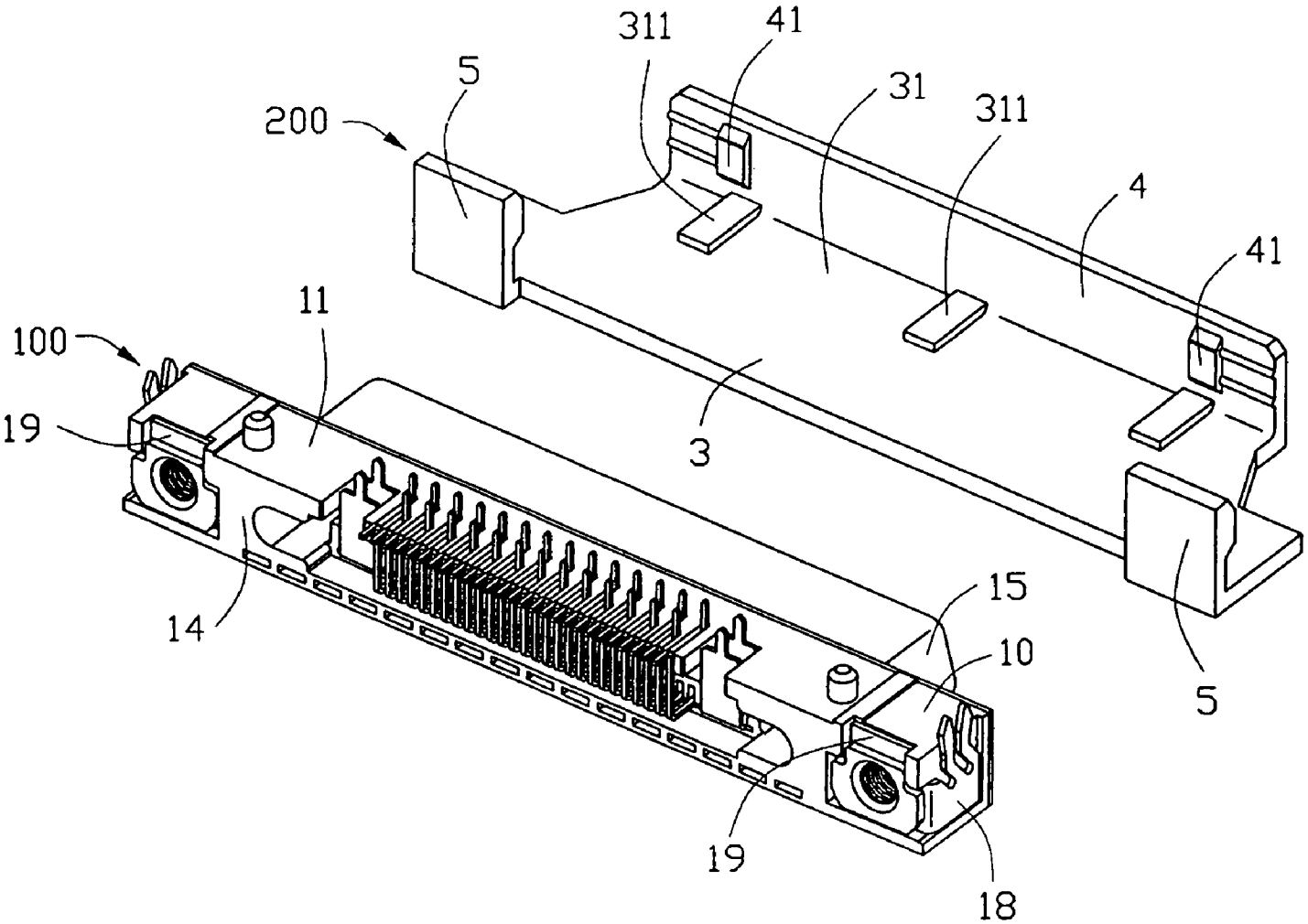
FIG. 4 is an exploded perspective view of the connector of FIG. 3 wherein a pick-up cap has been detached from the connector.

Referring to FIGS. 2 and 4, a connector assembly in accordance with the present invention includes a connector 100 and a pick-up cap 200. The connector 100 comprises a housing 1 and a plurality of terminals 2 loaded in the housing 1. The housing 1 has a base 10 and a mating portion 15 integrally formed from the base 10. The base 10 is substantially of a rectangle structure and has a lower face 11 serves as a mounting face for mounting on a PCB (not shown), an upper face 12 opposing to the lower face 11, a front face 13, and a rear face 14. The mating portion 15 projects forwardly from a longitudinal middle section of the front face 13 and defines a mating cavity 17 therein for receiving a mating portion of a mating connector (not shown), and therefore makes a front face 16 thereof that is perpendicular to the mounting face 11 a mating face. At each longitudinal end section of the base 10 is a through hole 130 disposed beside the mating portion 15. The terminals 2 include a plurality of signal terminals 21 arranged in two opposing rows, and each row also has a pair of power terminals 22 respectively at two opposite ends thereof. Wherein either the signal terminals 21 or the power terminals 22 each comprises a contact beam exposed in the mating cavity 17 for electrically contacting a conductor of the mating connector and a solder tail extending beyond the mounting face 11 to be soldered to the PCB.

The connector 100 additionally has a shell comprising a plate portion attached onto the front face 13 of the base and a frame portion integrally projecting from the plate portion and fitly attached to a periphery of the mating portion 15. The shell defines a pair of through holes aligning with the through holes 130 correspondingly. There is also a pair of board lock 18 for locking the connector 100 to the PCB which are respectively retained at each longitudinal end of the base 10. Each board lock 18 has a pair of retaining legs (not labeled) to be mounted onto the PCB.

Figure 5:
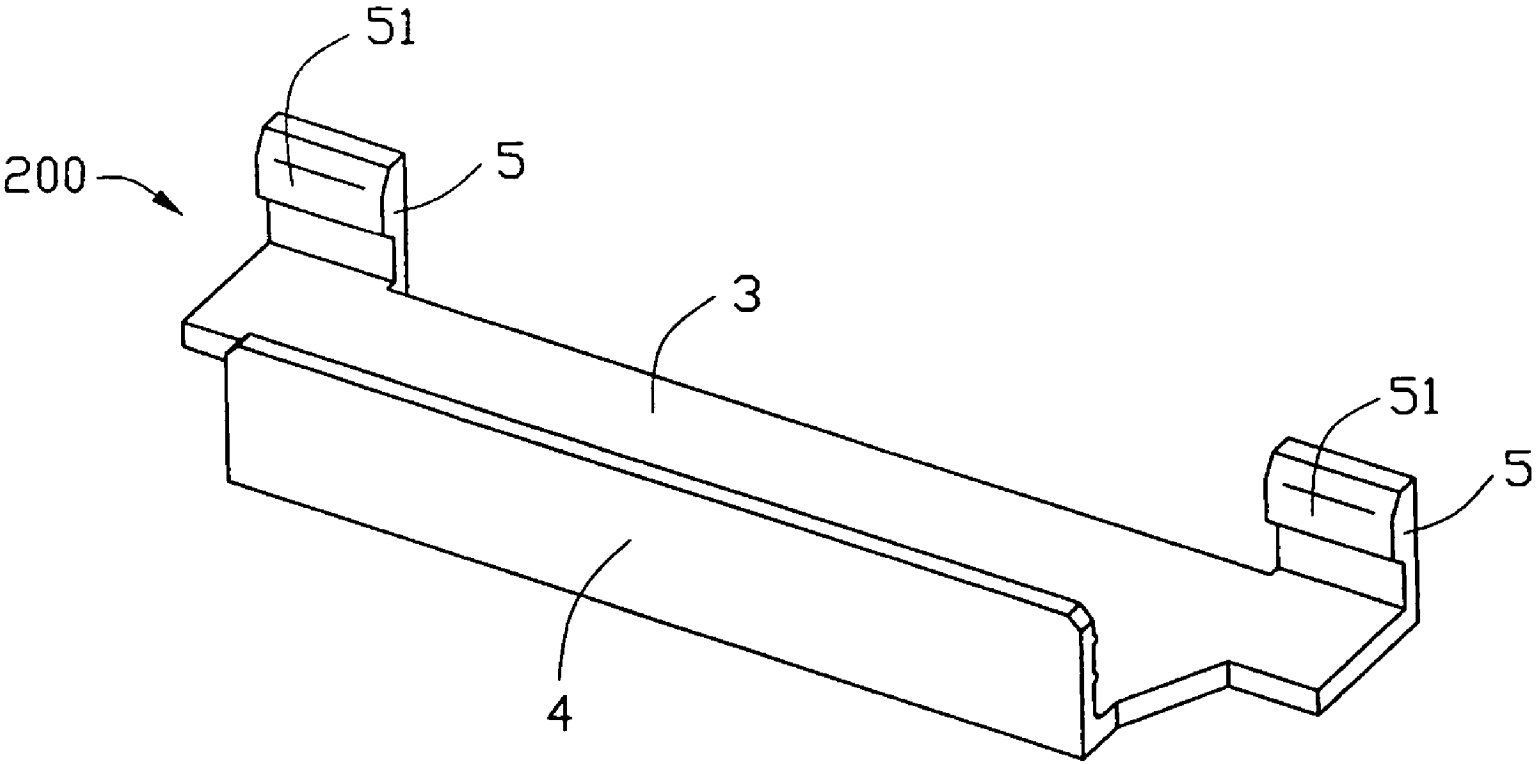
FIG. 5 is a perspective view of a pick-up cap of the connector assembly of FIG. 1.

Referring to FIGS. 2, 4 and 5, the pick-up cap 200 comprises a main plate 3 to be attached onto a top of the connector 100, a first retaining portion 4 extending down from a front edge of the main plate 3 to be retained to a front section of the connector 100, and a second retaining portion 5 extending down from a rear edge of the main plate 3 to be retained to a rear section of the connector 100. The main plate 3 is formed with a plurality of flat tubers 311 on a front section of its under surface 31 adjacent to the first retaining portion 4. The flat tubers 311 are spacedly arranged along a longitudinal direction of the main plate 3 corresponding to that of the base 10. While a rear section of the under surface 31 of the main plate 3 is abutting on the upper face 12 of the base 10, the flat tubers 311 abut on an upper face of the mating portion 15 which is located slightly lower than that of the base 10 to ensure horizontality of the main plate 3 in whole.

Figure 3:
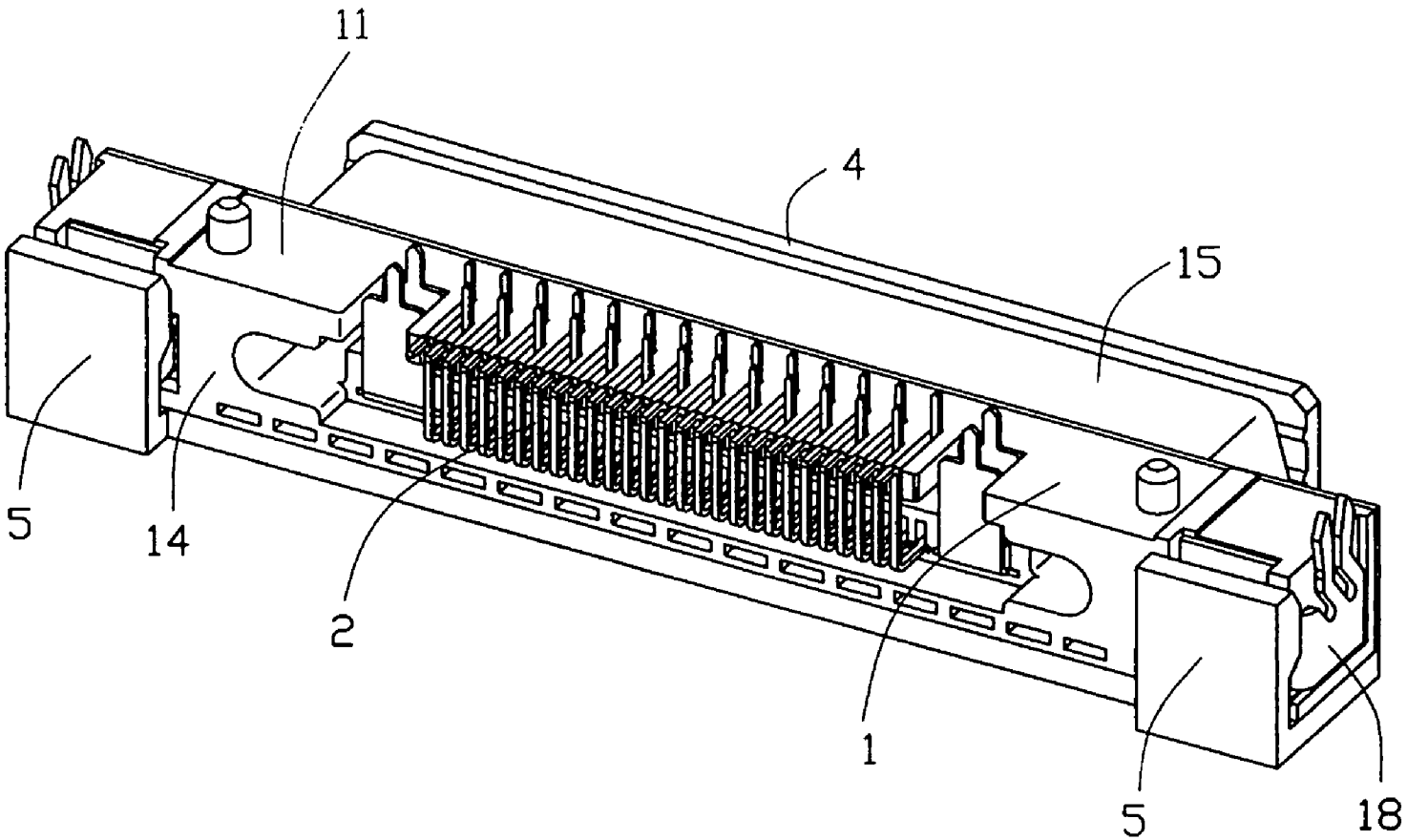
FIG. 3 is another assembled perspective view of the connector of FIG. 1 taken from a second aspect.

In this preferred embodiment, the first retaining portion 4 is of a plate structure which also serves as a cover to close the mating cavity 17 to protect the terminals 2 therein from being accidentally hit. The first retaining portion 4 has a pair of protuberances 41 on its inner surface thereof each to be retained in the mating cavity 17 at a position corresponding to the power terminals 22. The second retaining portion 5 comprises a pair of legs each having a barbed end 51 to be retained in a recess 19 defined in a rear face 14 of the base 10. Via the first and second retaining portion 4 and 5, the pick-up cap 200 is assembled on the connector 100, as best shown in FIGS. 1 and 3. In assembly, an upper surface 30 of the main plate 3, which is flat, smooth and large, serves as an engagement face for receiving suction by a vacuum transfer assembly. As the main plate 3 covers the whole top of the connector 100, both the top of base 10 and mating portion 15, a center of the upper surface 30 thereof on which suction of the vacuum transfer assembly is applied can align with a center of gravity of the connector 100 in a vertical direction. Thus the connector 100 can be reliably picked up and transferred by the vacuum transfer assembly. In addition, by covering of the first retaining portion 4, the terminals 2 in the mating cavity 17 are prevented from being accidentally destroyed.

However, the disclosure is illustrative only, changes may be made in detail, especially in matter of shape, size, and arrangement of parts within the principles of the invention.

What is claimed is:

1. An electrical connector assembly comprising:

an electrical connector comprising:

an insulative housing comprising a base having an under face adapted for mounting on a printed circuit board and a mating portion integratedly projected forwardly from the base and defining a mating cavity in a front face thereof;

a plurality of electrical terminals loaded in the housing and each having a contact portion exposed in the mating cavity;

a pick-up device releasable assembled to the connector and comprising a main plate attached onto a top of the housing to provide a flat upper surface adapted for receiving suction by a vacuum transfer assembly, the main plate covering both top faces of the base and the mating portion to making a center of the flat upper surface thereof substantially aligned with a center of gravity of the connector in a vertical direction perpendicular to the flat upper surface; and wherein the top face of the mating portion is located lower than that of the base wherein the pick up device formed with tuber on an under surfaces thereof abutting on the top face of the mating portion to wholly keep the main plate in a horizontal posture, wherein the pick up device further comprises an auxiliary plate perpendicular extending from the main plate to cover an opening of the mating cavity, wherein the auxiliary plate is formed with a protuberant portion inserted in the mating cavity and retained therein and thereby to retain the pick up device to the housing, wherein the pick up device further comprises a retaining portion extending from the main plate to be retained at a rear section of the housing, wherein the retaining portion comprises a pair of retaining legs each with barbed end received in corresponding recess defined in a rear face of the housing.

2. An electrical connector assembly comprising:

an insulative housing defining a base with a mating portion extending forwardly therefrom in a cantilever manner with a mating opening communicating with an exterior in a front-to-back direction;

a plurality of contacts disposed in the housing, each of said contacts including a mounting section extending outwardly from the base for soldering to a printed circuit board on which the base is seated, and a mating section extending into the mating portion for mating with a complementary connector; and a pick-up cap attached to the housing, said cap including a horizontal plate extending along said front-to-back direction and being dimensioned to be large enough to be used with a vacuum suction device for picking the connector, wherein the cap further includes a front vertical plate extending downwardly from a front edge of the horizontal plate to cover the mating opening, wherein the cap further includes a pair of rear vertical plates extending downwardly from a rear edge of the horizontal plate to cooperate with the front vertical plate to hold the cap to the housing, wherein the rear vertical plate is not aligned with the contacts in the front to back direction, wherein the top of the mating portion is located lower than that of the base.

* * * * *